US005571380A

United States Patent [19]

Fallon

[11] Patent Number: 5,571,380

[45] Date of Patent: Nov. 5, 1996

[54] PAPERMAKING PROCESS WITH IMPROVED RETENTION AND MAINTAINED FORMATION

[75] Inventor: Thomas C. Fallon, West Chicago, Ill.

[73] Assignee: Nalco Chemical Company, Naperville, Ill.

[21] Appl. No.: 818,033

[22] Filed: Jan. 8, 1992

[51] Int. Cl.[6] ..... D21H 21/06

[52] U.S. Cl. ..... 162/168.2; 162/168.3; 162/183

[58] Field of Search ..... 162/164.6, 168.2, 162/168.3, 183

[56] References Cited

U.S. PATENT DOCUMENTS

| | | | |
|---|---|---|---|
| 3,117,944 | 1/1964 | Harrell | 260/41 |
| 3,901,857 | 8/1975 | Sackman et al. | 162/168.3 |
| 3,907,758 | 9/1975 | Sackman et al. | 162/168.3 |
| 4,388,150 | 6/1983 | Sunden et al. | 162/175 |
| 4,643,801 | 2/1987 | Johnson | 162/164.1 |
| 4,753,710 | 6/1988 | Langley et al. | 162/164.3 |
| 4,874,466 | 10/1989 | Savino | 162/164.3 |
| 4,913,775 | 4/1990 | Langly et al. | 162/164.3 |

FOREIGN PATENT DOCUMENTS

| | | | |
|---|---|---|---|
| 759363 | 5/1967 | Canada . | |
| 8850001 | 7/1988 | European Pat. Off. . | |
| 129668 | 12/1988 | Japan . | |
| 631483 | 11/1949 | United Kingdom . | |
| 8403062 | 1/1986 | WIPO . | |
| 8501652 | 10/1986 | WIPO . | |
| WO8910447 | 11/1989 | WIPO | 162/168.3 |

OTHER PUBLICATIONS

"Microparticles in Wet End Chemistry", Kurt Moberg, Retention and Drainage short course, 1989, Washington, D.C., TAPPI Press, Atlanta, Georgia.

"Aluminum Based Microparticulate Retention Systems", Lindstrom, Hallgren and Hedborg, Nord. Pulp. Pap. Res. J., 1989, 4(2), pp. 99–103.

"Pulp and Paper", John Wiley & Sons, Inc., 3rd Ed., 1981, pp. 1448–1458 and 1602–1603.

Encyclopedia of chemical Technology, Kirk and Othmer, vol. 16, pp. 774–785 and 788–791.

Encyclopedia of Chemiccial Technology, Kikr and Othmer, vol. 16, pp. 804 to 810.

Literature Search report entitled "use in Retention/drainage Programs," pp. R1 to R11, listing 91 reference.

Literature Search report, Retention/drainage Aid–dual systems, pp. 5–6, 19–22, 100–103, 136–139, 187–188, 193–198, and 261–262.

*Primary Examiner*—Peter Chin

*Attorney, Agent, or Firm*—Robert A. Miller; James J. Drake

[57] ABSTRACT

A process in which paper or paperboard is made by forming an aqueous cellulosic slurry, draining said slurry on a screen to form a sheet and drying said sheet, employs a cationic polymer as a substantially single component retention aid. The cationic polymer has a cationic charge density of at least about 3.2 equivalents of cationic nitrogen per kilogram of dry polymer. The cationic polymer also has an Intrinsic Viscosity of at least about 8 dl/g. The polymer is added to the slurry prior to sheet formation in an amount effective to provide at least about a 50 percent increase in retention without more than about a 10 percent decrease in formation.

20 Claims, No Drawings

PAPERMAKING PROCESS WITH IMPROVED RETENTION AND MAINTAINED FORMATION

TECHNICAL FIELD OF THE INVENTION

The present invention is in the technical field of increasing the retention in the papermaking process while retaining high formation values.

BACKGROUND OF THE INVENTION

Paper and paper board are produced by forming a a fiber mat from an aqueous cellulosic slurry and drying such fiber mat to provide a finished sheet which routinely has less than 6 weight percent of water. The fiber mat is formed on a moving wire (endless wire belt) or web, and is then subjected to dewatering and drying steps. The cellulosic slurry typically has a consistency (percent dry weight of solids in the slurry) of less than 1 percent, and commonly below 0.5 percent, at the time it is employed to form the wet fiber mat. Such low consistencies are generally necessary to produce a finished sheet having a reasonable formation. Such low consistencies routinely require that the cellulosic slurry be diluted ahead of the paper machine.

One aspect of papermaking that is extremely important to its efficiency and cost is the retention of furnish components on and within the fiber mat being formed during the papermaking process. A papermaking furnish may contain particles that range in size from about colloidal size, to the 2 to 3 millimeter size of cellulosic fibers. Within this range are cellulosic fines, mineral fillers (employed to increase opacity, brightness and other paper characteristics) and other small particles. Such small particles in the furnish would in significant portion pass through the spaces (pores) between the cellulosic fibers in the fiber mat being formed without the inclusion of one or more retention aids. Thus the inclusion of retention aids as wet end additives in the papermaking process is both widely practiced and very important to the process.

A greater retention of fines and fillers permits, for a given grade of paper, a reduction in the cellulosic fiber content of such paper. As pulps of less quality are employed to reduce papermaking costs, and reduce the demand on raw material supplies, the retention achieved becomes even more important because the fines content of lower quality pulps is greater than that of higher quality pulps.

A greater retention of fines, fillers and other slurry components reduces the amount of such substances that are lost to the white water, and hence reduces the amount of material waste, the cost of waste disposal and the adverse industrial and environmental effects of significant material loss to the white water.

Another important aspect of papermaking is the formation of the finished sheet. Formation is a measure of the uniformity of the paper sheet. Formation is generally determined by the variance in the light transmission property within a paper sheet, and a high variance is indicative of poor formation. When retention aids are utilized to increase retention, the formation property is generally seen to decline. The need for a reasonable formation is often a limiting factor in achieving higher levels of retention.

A further important aspect of the papermaking process is the efficiency of drainage of the wet fiber mat. As noted above, the cellulosic slurry is diluted to a consistency of less than one percent for the fiber mat formation stage, and the finished sheet has a water content of less than 6 weight percent. A significant amount of the water is removed while the fiber mat is on the wire. Initially the water may drain freely through the fiber mat and wire by gravitation force, and thereafter the consistency of the fiber mat on the wire may be raised to about 15 to 20 percent by the use of vacuum suction to remove water. After leaving the wire the fiber mat is dewatered further by means such as pressing, felt blanket blotting and pressing, evaporation and the like. In practice a combination of such methods are utilized to dry the sheet to the desired water content. Since free drainage is both the first and least expensive dewatering method used, its efficiency should at least be maintained in any papermaking process. The goals of increasing the retention while maintaining good formation should not be achieved at the expense of efficient drainage.

It is generally desirable to minimize the amount of additives employed for various purposes in a papermaking process, to the extent possible while obtaining the result sought. Additive minimization may realize material cost savings and handling and processing benefits. In addition, minimization of additives reduces the risks of adverse effects from such additives. For instance, the use of some wet end additives at high levels can be detrimental to other papermaking aspects, such as the dry strength of the finished paper sheet.

It is also generally desirable to use additives that may be delivered to the paper machine without undue problems. Additives that are easily dissolved or dispersed in water minimize the expense and energy required for delivering them to the paper machine and provide a more reliable uniformity of feed than additives which are not easily dissolved or dispersed.

DISCLOSURE OF THE INVENTION

The present invention provides a papermaking process in which paper or paperborad is made by the general steps of forming an aqueous cellulosic slurry and draining such slurry to form a fiber mat which is then dried, characterized by the addition of a high molecular weight, high charge density cationic polymer to such slurry before such fiber mat formation. The present invention provides such a papermaking process in which the retention is increased without diminishing the formation, and further without any undue detrimental effect on drainage efficiency. The high molecular weight, high charge density cationic polymer is effective at low dosage levels and is easily dissolved or dispersed in water. At the use levels preferred for the present process, such high molecular weight, high charge density cationic polymer has no known deleterious effects on any aspect of papermaking, and none are expected to become manifested even at dosages that are higher then the preferred dosage levels.

PREFERRED EMBODIMENTS OF THE INVENTION

The use of polymers of various types for the purpose of improving retention performance in papermaking processes is well known. Such polymers range from "natural" polymers, such as cationic starch, to synthetic polyelectrolytes of wide variety. Such polyelectrolytes include anionic polymers, cationic polymers, and possibly even amphoteric polymers. Such polymers also include nonionic polymers, such as the nonionic, but polar, polyacrylamides. These polymers are typically water soluble at the concentration levels employed, or at least water dispersible. A common retention aid system, referred to as a dual polymer system, employs a cationic polymeric coagulant followed by an anionic polymeric flocculant. The functional terms coagulant and flocculant of course are based on the effect a polymer has on the cellulosic slurry particles. A coagulant generally neutralizes the negative surface charges of such particles; a flocculant binds to sites on a plurality of such particles, providing a bridging effect. As to the structural characteristics distinguishing a polymeric coagulant from a polymer flocculant, a coagulant is a low molecular weight polymer while a flocculant is a high molecular weight polymer. A coagulant further must be cationic so as to neutralize the negative particle surface charges. A flocculant generally is, but need not be, anionic. High molecular weight cationic polymers have been used in papermaking processes, and such polymers are at times referred to as cationic flocculants. Such cationic flocculants are, however, relatively low charge density polymers, having mole percentages of cationic mer units of about 10 percent and charge densities on the order of 1.0 or 1.2 equivalents of cationic nitrogen per kilogram of dry polymer or less. In contrast, the low molecular weight polymers employed as coagulants typically have high charge densities, such as from about 4 to about 8 equivalents of cationic nitrogen per kilogram of dry polymer.

The high molecular weight, high charge density cationic polymer employed in the present process as a retention aid provides an industrially acceptable improvement in retention without any significant loss in formation, as compared to a process differing only in the absence of such retention aid. In preferred embodiment, the cationic polymer employed in the present process provides at least about a 50 percent improvement in retention without any loss in formation greater than 10 percent. In more preferred embodiment, the cationic polymer employed in the present process provides at least about a 50 percent improvement in retention no more than about a 5 percent decrease in formation. Such performance standards are of course met by selection of an appropriate dosage of a given cationic polymer for a given papermaking process. For any combination of cationic polymer and papermaking process, it is believed that the dosage of the cationic polymer can be lowered to a point at which insufficient retention improvement ensues. Similarly for any such combination it is believed that the dosage of the cationic polymer can be raised to a point at which formation deteriorates to an undesirable level. The selection of an appropriate dosage range for a given cationic polymer within the scope of the present process and a given papermaking system is, however, within the skill of an ordinary artisan in the papermaking field. A simple laboratory screening as described herein for Example 1 is sufficient for dosage selection. The references above, and elsewhere herein, to retention improvement and formation loss or decrease are determined in reference to a process differing only by the absence of the high molecular weight, high charge density cationic polymer. It is believed that the employment of cationic polymers outside of the molecular weight (as defined by Intrinsic Viscosity) and/or charge density requisites of the present process will not meet these retention/formation standards at any reasonable dosage.

The cationic polymer of the process of the present invention has a very high charge density. Such charge density should be at least about 3.2 equivalents of cationic nitrogen per kilogram of dry weight of polymer. In preferred embodiment, the charge density of the cationic polymer is at least about 3.3, or 3.5, equivalents of cationic nitrogen per kilogram of dry weight of cationic polymer. The preferred range(s) of charge densities of the cationic polymer may include cationic/nonionic copolymer types of cationic polymers. For instance, a 50/50 mole ratio acrylamide/dimethylaminoethylacrylate methyl chloride quaternary ammonium salt copolymer, such as the polymer used in Example 1 below, has a charge density of about 3.75 equivalents of cationic nitrogen per kilogram of dry polymer. Hence this nonionic/cationic copolymer is within the preferred charge density range, having a charge density in excess of 3.5.

The cationic polymer of the process of the present invention is a substantially linear polymer having an intrinsic viscosity of at least about 8, and in preferred embodiments at least about 10 or 12. The upper limit of intrinsic viscosity for the cationic polymer of the present process is believed primarily dictated by economic practicalities; the formation of cationic polymers that are both substantially linear and have intrinsic viscosities in excess of about 20 typically require extraordinary synthesis techniques and there is no performance-based reason for using such high Intrinsic Viscosity polymers. There is, however, no known performance-based upper limit for the intrinsic viscosity of the polymer of the present invention, provided that such polymer is soluble or at least dispersible in water at the dosage level desired, and preferable at a convenient concentration level for charging to the cellulosic slurry.

Such a substantially linear polymer includes polymers that are slightly cross-linked, provided that their Structures are substantially linear in comparison, for instance, with the globular structure of a cationic starch.

The cationic polymer is used in the present process as a substantially single-component retention aid. It requires no other retention aid ahead of its addition to the slurry or subsequent thereto. It requires no other retention aid to be added concommitantly therewith. Moreover, given the advantageous balance between retention and formation that is desired of, and provided by, the present invention, the use of materials that could be deemed additional retention aids are advantageously avoided. Materials that might be deemed themselves retention aids are typically materials that have, or may have, a coagulation or flocculation effect on the solids of the slurry. Such materials may be cationic, anionic or nonionic, and may be low molecular weight polymers, or medium or high molecular weight polymers. They may be charged mini- or microparticles. If a papermaking process for any reason uses such an additive, the use of the present process should preferably be tested in conjunction therewith to determine whether any significant effect on performance ensues. If the use of such other additive or additives reduces the present process's performance parameters below the minimum (discussed elsewhere herein), such other additives should be reduced in amount or excluded, whichever is necessary to regain the minimum performance parameters. Thus the present invention does not necessarily exclude the use of other additives to the cellulosic slurry. The present invention may be, and herein is, defined as permitting other additives provided that such other additives do not decrease performance parameters (retention and formation) below the minimum set forth for the present invention.

The cationic polymer is employed in the present invention as an additive charged to the slurry generally after the last of the high shear stages, and prior to formation of the fiber mat. Before the formation of the fiber mat, the cellulosic slurry typically is subjected to one or more high shear stages. High shear stages that are routinely encountered in a typical papermaking process include fan pumps, centriscreens and other devices providing shear to the cellulosic slurry of a comparable degree. In a simulated papermaking process on a laboratory scale, a hig shear stage would be provided in an apparatus such as a Britt jar stirring at about 1800 or 2000 rpm or higher. The advantageous balance between retention and formation that is desired of, and provided by, the present invention, may be diminished if the cationic polymer is added prior to, or at the point of, a high shear stage. Such addition point may reduce the performance parameter of retention to a level below the minimum (discussed elsewhere herein) required of the present invention. The possibility of polymer addition prior to, or at the point of, a high shear stage, is however not excluded for all processes.

The cationic polymer used in the present process may include cationic mer units such as dialkyl amino alkyl(meth)acrylates, either as the quaternary ammonium salts or as the acid salts. Such cationic mer units include dimethylaminoethylacrylate and dimethylaminoethylmethacrylate ("DMAEA" and "DMAEM" respectively) as quaternary ammonium salts, for instance the methyl chloride or methyl sulfate quats, or as an acid salt, such as the sulfuric acid salt. Such cationic mer units are preferably those wherein the aminoalkyl groups contain at least one but no more than 8 carbons, and the alkyl groups contain at least one but no more than about 4 carbons. Such cationic mer units may be present in copolymers with nonionic mer units, such as acrylamide mer units. To provide the required minimum charge density, in a polymer such as a copolymer of DMAEA.MCQ (methyl chloride quat of DMEA)/acrylamide), the mole percent of the DMAEA.MCQ cationic mer unit should be at least about 40 percent. As a comparison, a copolymer of such cationic mer units and acrylamide for general use in the papermaking field for retention purposes would be selected so as to have a mole percent of the cationic mer unit of only about 10 percent.

It has been demonstrated that copolymers of dialkyl aminoalkyl(meth)acrylates (in cationic form) and (meth-)acrylamide are suitable for use as the cationic polymer of the present invention, provided those selected have the requisite cationic charge density and molecular weight (as measured by Intrinsic Viscosity). It is known in the polymer art that acrylamide-containing polymers may contain a minor amount of acrylic acid or acrylic acid salt mer units due to inadvertent hydrolysis of some acrylamide mer units, even though the polymer is not subjected to conditions that would hydrolyze a substantial proportion of the acrylamide. It is believed that the presence of a minor proportion of hydrolyzed acrylamide mer units (or hydrolyzed methacrylamide mer units) will not cripple the performance of a cationic polymer that otherwise meets the requirements for use in the present process. Further, it is believed that the presence of up to about 5 mole percent anionic mer units in the polymer is not harmful to the polymer's performance. Hence the term "cationic" as used herein includes polymers containing a minor amount of anionic mer units, although of course the primary nature of the polymer remains cationic.

In a preferred embodiment, the cationic polymer used in the present process is a polymer containing as the cationic mer unit a dialkyl aminoalkyl(meth)acrylate quaternary ammonium salt, wherein the aminoalkyl group contains at least one but no more than about eight carbons, and the alkyl radicals of the dialkyl groups separately contain at least one but no more than about four carbons. In more preferred embodiment, such dialkyl aminoalkyl(meth)acrylate quaternary ammonium salt mer unit is a DMAEA or DMAEM quaternary ammonium salt. In such preferred embodiments the polymer is also preferably a copolymer with (meth)acrylamide. Such polymers must, of course, have the requisite cationic charge densities and Intrinsic Viscosities, as discussed elsewhere herein.

It is believed that polymers containing other types of cationic mer units may also be useful for the present process, if such polymers were available with the requisite cationic charge densities and Intrinsic Viscosities.

The cationic polymer used in the present process must, in any instance, be water soluble or at least water dispersible at the concentration level employed.

The high molecular weight, high charge density cationic polymer may be charged to the cellulosic slurry before, at the point of, or after the high shear stage(s) of the given papermaking process. At most any of such charge points the slurry typically would be of or about the consistency intended for the fiber mat formation stage. If for any reason the cellulosic slurry is at a higher consistency at the desired charge point, the addition of the cationic polymer prior to a slurry dilution step is believed acceptable, provided that the slurry consistency is not so high as to interfere with dispersion of the cationic polymer in the slurry. In general, the consistency of the cellulosic slurry at the point of addition of the cationic polymer should be within the range of from about 0.1 to about 4.0, and preferably from about 0.3 to about 0.7.

The papermaking process of the present invention includes processes wherein inorganic or mineral fillers are added and processes in which no such fillers are used. The cationic polymer of the present invention acts on both fines and fillers as to retention.

When a filler is used, it is most commonly charged to the stock before at least one of the high shear stages of the given papermaking process. Since the cationic polymer is to act on both the filler and any fines present in the cellulosic slurry, the cationic polymer is believed most effective when it is charged after the filler addition, regardless of the point of filler addition.

Commonly used inorganic or mineral fillers include alkaline carbonates, such as calcium carbonate, titanium dioxide, kaolin clay, and the like. The amount of inorganic filler typically employed in a papermaking stock is from about 10 to 30 parts by weight of the filler, as $CaCO_3$, per hundred parts by weight of dry pulp in the slurry. The amount of filler may, at times, be as low as about 5, or even about 2, parts by weight, or as high as about 50, or even 80 or 90, parts by weight, per hundred parts by weight of dry pulp in the slurry.

The present process can employ a cellulosic slurry that has been treated with a cationic binder, such as a cationic starch or amino resin, such as a urea formaldehyde resin, or a relatively low molecular weight dry strength resin that is more cationic than anionic. Such additives are typically charged to a slurry in amounts of from about 0.01 to 1.0 weight percent, based on dry solids in the slurry. When a stock has a high cationic demand and/or contains significant amounts of pitch, the cellulosic slurry may contain up to about 0.5 weight percent (based on dry slurry solids) of a second cationic polymer having an Intrinsic Viscosity generally below 5, and often below 2, and a molecular weight within the range of from about 50,000 to about 400,000. Such second cationic polymer would be present in the cellulosic slurry prior to the addition of the high molecular weight, high charge density cationic polymer of the present process.

Other additives routinely used in papermaking processes include sizing agents, such as alum and rosin, pitch control agents, extenders such as anilex, biocides and the like. Such common papermaking additives are believed to provide no substantial interference with the present process as such additives are commonly used. As discussed elsewhere herein, however, if the selection of additive and/or manner of using such additive creates a possibility that such additive may have a coagulation or flocculation effect on the solids in the cellulosic slurry, the present process should be first tested on such stock to assure there is no significant interference with the single-component retention system of the present process.

In preferred embodiment, the cellulosic slurry should be, at the time of addition of the high molecular weight, high charge density cationic polymer, anionic or at least partially anionic. The selection of other papermaking additives therefore should be made with such anionic nature of the slurry as a limiting factor.

The amount of high molecular weight, high charge density cationic polymer that may be used in the process of the present invention may be within the range of from about 0.001 to about 0.5 parts by weight per hundred parts by weight of dry solids in the cellulosic slurry, such dry solids including both dry pulp solids and, if present, dry filler solids. In preferred embodiment the cationic polymer is used in the amount of from about 0.01 to about 0.03 parts by weight per hundred parts by weight of dry solids in the cellulosic slurry.

When filler is used in the papermaking stock the level of such cationic polymer may also be correlated to the amount of filler present. The cationic polymer used may be within the range of from about 0,002 to about 1.0 parts by weight per hundred parts by weight of the filler, as $CaCO_3$, in the cellulosic slurry, and preferably will be in the range of from about 0.01 to about 0.03 parts by weight, same basis.

In broader concept, the amount of high molecular weight, high charge density cationic polymer that may be used in the present papermaking process is at least the amount effective to provide at least a 50 percent improvement in retention with no more than a 10 percent loss in formation, as compared to the same process but without the cationic polymer of the present invention. It is believed that with at least some of the cationic polymers useful for the present invention an effective amount will be defined both in terms of a minimum and a maximum charge of cationic polymer for a given cellulosic slurry.

The process of the present invention is believed applicable to all grades and types of paper products, both filled and unfilled. The present process is believed applicable for use with all types of pulps, including, without limitation, chemical pulps, such as sulfate and sulfite pulps from both hard and soft woods, thermo-mechanical pulps, mechanical pulps and ground wood pulps. It is also believed that the process of the present invention is applicable to cellulosic slurries of widely varying pH's, such as for instance an alkaline chemical pulp which generally has a pH is the range of from about 6.0 to about 9.0, and more commonly in the range of from about 6.5 to about 8.0, and acid pulps which typically have pH's below about 6.5.

The Intrinsic Viscosities of the polymers as reported herein, including both the cationic polymers of the present invention and the polymers noted herein as comparatives, were determined in a 1.0 molar aqueous solution of sodium nitrate from published data. The Intrinsic Viscosity values given herein are in terms of dl/g of polymer. The Reduced Specific Viscosities of the polymers as reported herein were determined in the same solvent, at a polymer concentration of 0.045 wt. percent. Any molecular weight values noted herein for any polymer are approximate weight average molecular weights.

Standard Test Procedure For Retention Determination

The following test procedure is a laboratory method that simulates a paper machine and provides data concerning retention, drainage and other performance parameters. The data provided by this test procedure is comparable to that realized in the commercial papermaking process being simulated. A 500 ml. sample of standard stock (cellulosic slurry) is used. Any adjustments necessary to the stock's consistency and pH are made prior to charging the treatment and/or commencement of the mixing. A Britt jar (developed by K. W. Britt of New York State University) is employed as the mixing vessel to provide a standard degree of shear. This apparatus is comprised of a chamber having a capacity of about one liter and is provided with a variable speed motor equipped with a two-inch three-bladed propeller. The sample of standard stock is first added to the Britt jar and then the treatment is added. The stock/treatment combination is then mixed at a speed and for the time period desired, after which it is immediately poured into the reservoir of an Alchem retention and drainage apparatus. This reservoir is suspended over a funnel which in turn is open to a graduated cylinder. The bottom of the reservoir is a 60 mesh stainless steel screen. After the treated and mixed stock is poured into the reservoir, a plug (opening the reservoir to the screen) is pulled, and liquid is allowed to drain freely through the screen for a five second time period. That liquid is collected in the graduated cylinder, and is referred to as the filtrate. A sample of the filtrate is removed for turbity measurement. The retention parameter is determined as a percent retention improvement in comparison to a blank, for which the same test variables are used except that no treatment is added. Such percent first pass retention improvement ("R") is calculated from the turbity values ("T") by the following equation:

$$R = \frac{T_{Blank} - T_{Sample}}{T_{Blank}} \times 100$$

wherein the subscribe references are to T values determined for the blank or the sample for which percent improvement is being determined.

The variables used in all instances for this standard procedure are set forth below in Table 1.

TABLE 1

| Variable | Standard Used |
|---|---|
| Stock Pulp | 50/50 weight ratio of bleached hardwood Kraft/softwood Kraft |
| Pulp C.F.S. | Canadian Standard Freeness value in the range of from 340 to 380 C.F.S. |
| Stock Filler | Calcium carbonate in the amount of 30 parts by weight, as $CaCO_3$, per 70 parts by weight dry pulp solids |
| Stock Consistency | 0.5 percent |
| Mixing Speed | 1000 rpm |
| Mixing Time after treatment addition | 10 seconds |

In all instances in this Standard Test Procedure, the treatment polymer was added as an aqueous solution having a concentration of polymer actives (dry polymer) of 0.1 weight percent. The treatment dosages are set forth herein generally in terms of lb. of polymer actives per ton of dry stock solids (pulp and filler). Since the amounts of treatment solution employed for a 500 ml. sample of slurry at 0.5 percent consistency are of the order of a few milliliters or less, a syringe was used to charge the correct dosage to the stock.

In addition to determining the retention performance of the additives, the volume of the filtrates collected during such five second time periods were determined as an indication of the drainage parameter. A reasonable drainage is shown by a volume of filtrate that is notably greater than the blank.

Digital Image Analysis Formation Test

Formation was tested using an automated digital image analysis technique developed by Robotest Corporation of Gens Falls, N.Y. The basic components of the test unit include a black and white Panasonic CCD type camera with the CCD sensor arranged as 510 by 492 picture elements. The camera's spectral response closely resembles the human eye with regard to intensity over the color spectrum. Another basic component is a frame grabber board which digitizes the picture received from the camera into 512 by 480 picture elements. Each picture element, or pixel, is represented by two parameters, that is, the location and the intensity level. The intensity level scale ranges from 0 for black up to 255 for white, the levels in between being grey levels which are separated by a sensitivity of 0.017578 volts per grey level. The recognition of 256 grey levels gives the board a resolution several times that of the human eye, and thus a much higher sensitivity to intensity variations is provided to the board than the human eye. The light source employed is an incandescent light run off a one percent DC supply to avoid illumination variants which occur over time when a lamp is powered directly from an AC source. To provide even illumination, the incandescent source is focussed so as to cover an area larger than the field of view and then two levels of diffusion are interposed to provide illumination approaching even diffusion. Then the circular patterns of slightly varying intensity of illumination are corrected for in a software algorithm which ratiometrically compares the reference image of the illumination surface with the image of the sample being processed and subtracts the illumination surface variations, leaving a true compensated image of the paper sample. The automation power is provided by a special package containing 640K of memory, a static RAM virtual 360K disk, and parallel and serial interfaces. The formation measurement is based on an index of the uniformity of the optical light transmission through the paper sample over its entire area. After the compensated image of the paper sample is stored in the frame grabber's frame memory, a two-dimensional software window scans the entire frame, yielding average intensities that can be compared to one another. Smaller local pixel variations are compared to these windows, providing both regional and local variation data. Data points numbering more than 200,000 are considered, and are divided into 64 difference levels. Each such difference level is separated by approximately 1 percent of the intensity level scale. Thereby an array of 64 sample intervals are compiled, each representative of the number of accumulated data points that differ in intensity level from their neighboring region by a percentage of the total mean intensity of the entire sample area (6 sq. inches as 2.1"×2.86"). The index provided is indicative of the gradient, or rate of change, of intensity over the sample sheet in two dimensions. Combined hardware and software techniques control the mean intensity of each sample to within 0.4% of the center of the 64 difference levels, rendering the formation measurement almost independent of sample weight variations. The scale is expanded to utilize the full resolution of the 64 difference levels and then divided to provide an index from about 20 to about 120. The higher the percentage of sample area that is closer to the mean, the higher is the formation of the sample, and the higher is the formation index of such sample. The highest possible formation index is about 122.4, which is the formation index provided by the illumination source alone, which is 99 percent within 1% of the mean intensity over the entire surface.

EXAMPLE 1 and Comparative Examples (a) to (c)

The above described Standard Test Procedure for determination of retention improvement was used for a series of treated samples and a blank. All of the treated samples were dosed with a cationic polymer as a single polymer treatment. Different cationic polymers were used for each test set. In each instance the polymer was a copolymer of acrylamide ("AcAm") and dimethylaminoethylacrylate methyl chloride quaternary ammonium salt ("DMAEA.MCQ"). The polymers were selected so as to have similar Intrinsic Viscosities ("IV") and Reduced Specific Viscosities ("RSV"). The predominant variation among such polymers was the mole percent of the cationic mer unit (DMAEA.MCQ). Then for each treated sample and the blank,handsheets were made and the formation index determined by the Digital Image Analysis Formation Test described above. The parameters of greatest interest were the percent decrease in formation, compared to the blank, at 30% and 50% improvement in retention for each polymer. Since retention improvement varied with polymer dosage, in each test set for a given polymer several treated samples were run, each having a different polymer dosage. For each polymer set, the percent retention improvement was plotted versus the formation index and from such graph the approximate formation index at 30% and 50% retention improvement was determined. For each of Example 1 and Comparative Examples ("Comp.Ex.") (a) through (c), the polymer characteristics are set forth in Table 2 below, the dosages, percent improvement in retention and formation index are set forth in Table 3 below, and the percent decreases in formation index value (as compared to the blank) and 30% and 50% retention improvement are set forth in Table 4 below.

TABLE 2

| Example or Comp. Ex. No. | Polymer Characteristics | | |
|---|---|---|---|
| | Mole Percent DM4AEA.MCQ | RSV | IV |
| (a) | 1 | 24 | 19 |
| (b) | 10 | 18 | 15 |
| (c) | 30 | 21 | 15 |
| 1 | 50 | 18 | 15 |

TABLE 3

| Example or Comp. Ex. No. | Polymer Actives Dosages (lb/dry ton) | Retention Improvement (%) | Formation Index |
|---|---|---|---|
| blank | none | 0 | 61 |
| (a) | .15 | 48 | 47 |
| | .30 | 66 | 39 |
| | .60 | 82 | 34 |
| (b) | 0.65 | 20 | 58 |
| | .13 | 60 | 45 |
| | . 26 | 81 | 43 |
| (c) | .075 | 24 | 59 |
| | .15 | 64 | 49 |
| | .30 | 76 | 47 |

TABLE 3-continued

| Example or Comp. Ex. No. | Polymer Actives Dosages (lb/dry ton) | Retention Improvement (%) | Formation Index |
|---|---|---|---|
| 1 | .15 | 52 | 60 |
| | .22 | 68 | 57 |

TABLE 4

| Example or Comp. Ex. No. | Percent Decrease in Formation | |
|---|---|---|
| | At 30 Percent Retention Improvement | At 50 Percent Retention Improvement |
| (a) | 16 | 29 |
| (b) | 13 | 23 |
| (c) | 7 | 18 |
| 1 | 0 | 2 |

As shown in Table 3 above, none of the polymers used in the Comparative Examples approaches the standard of providing at least a 50 percent improvement in retention with no greater decrease in formation than 10 percent.

Moreover, as seen from the data of Table 3 above, the polymer of Example 1 digresses from the performance pattern provided by Comparative Examples (a) through (c). At a constant polymer actives dosage level of, for instance, about 0.15 lb/dry ton, the Comparative Examples provide a percent retention increase performance pattern wherein the performance is higher for the polymers with higher mole ratios of cationic mer unit, and a graph of retention increase versus cationic charge density indicates, at 0.15 lb/dry ton dosages, a sharp retention improvement for the 10 mole percent Comparative Example (b) over the 1 mole percent Comparative Example (a), and a levelling off of performance increase at about 30 mole percent cationic polymer charge density. That pattern does not continue for a 50 mole percent cationic polymer such as present Example 1, which at a dosage level of 0.15 lb/dry ton provides a retention improvement percent not much more than the 1 mole percent cationic polymer of Comparative Example (a). Further, although for each polymer the retention performance increases with increased dosage levels, for dosages of 0.15 lb/dry ton and higher, the rate of increase in retention performance with increasing dosages is greater for the Comparative Examples (a) through (c) than for Example 1, at least within the dosage range of from about 0.15 to about 0.30 lb/dry ton of stock solids. As shown in Table 5 below, in terms of the volume of the filtrates collected for these tests, the polymer of the present invention provided reasonable drainage.

TABLE 5

| Example or Comparative. Example No. | Polymer Actives Dosages (lb/dry ton) | Filtrate Vol. (cc) |
|---|---|---|
| blank | 0 | 130 |
| (a) | 0.15 | 150 |
| | 0.30 | 170 |
| | 0.60 | 170 |
| (b) | 0.13 | 168 |
| | 0.26 | 170 |
| | 0.46 | 172 |
| (c) | 0.15 | 150 |
| | 0.30 | 169 |

TABLE 5-continued

| Example or Comparative. Example No. | Polymer Actives Dosages (lb/dry ton) | Filtrate Vol. (cc) |
|---|---|---|
| | 0.52 | 184 |
| 1 | 0.15 | 148 |
| | 0.30 | 160 |
| | 0.52 | 170 |

The terms anionic polymer and cationic polymer as used herein at minimum specify the predominant ionizable groups within such polymer. The term aqueous cellulosic slurry or cellulosic slurry as used herein means a pulp-containing slurry in a water-continuous medium. The term pulp as used herein includes both cellulosic fibers and fines. The term stock as used herein has the same meaning as cellulosic slurry or aqueous cellulosic slurry.

Industrial Applicability of the Invention

The present invention is applicable to the papermaking industry, including such segments of the papermaking industry that manufacture paper or paperboard or the like.

I claim:

1. A process in which paper or paperboard is made by forming an aqueous cellulosic slurry, draining said slurry on a screen to form a sheet and drying said sheet, chracterized in that a cationic polymer having a quaternary ammonium salt cationic charge density of at least about 3.2 equivalents of cationic nitrogen per kilogram of dry polymer and having an Intrinsic Viscosity of at least about 8 dl/g is added to said slurry after the last high shear stage and prior to said draining of said slurry in an amount effective to provide at least about a 50 percent increase in retention wherein said increase in retention is obtained without more than about a 10 percent decrease in formation index as measured by digital image analysis on an index of from about 20 to about 120.

2. The process of claim 1 wherein said cationic polymer has an Intrinsic viscosity of at least about 10 dl/g.

3. The process of claim 1 wherein said cationic polymer has a quaternary ammonium salt cationic charge density of at least about 3.5 equivalents of cationic nitrogen per kilogram of dry polymer.

4. The process of claim 1 wherein said quaternary ammonium salt cationic charge density of said cationic polymer is substantially comprised of the cationic mer units of dialkyl aminoalkyl(meth)acrylates quaternary ammonium salts or mixtures thereof.

5. The process of claim 4 wherein the aminoalkyl groups of said dialkyl aminoalkyl(meth)acrylates quaternary ammonium salts contain from one to eight carbons.

6. The process of claim 4 wherein the alkyl groups of the dialkyl radicals of said dialkyl aminoalkyl(meth)acrylates quaternary ammonium salts separately contain from one to four carbons.

7. The process of claim 4 wherein said cationic polymer is a copolymer comprised substantially of said dialkyl aminoalkyl(meth)acrylates quaternary ammonium salts and (meth)acrylamide.

8. The process of claim 1 wherein said cellulosic slurry has a consistency of from about 0.10 to about 4.0 at the point of said addition of said cationic polymer.

9. The process of claim 1 wherein said cationic polymer is added to said slurry in the amount of from about 0.001 to about 0.5 parts by weight per hundred parts by weight of dry solids in said slurry.

10. The process of claim 1 wherein said slurry contains from about 10 to about 30 parts by weight of an inorganic filler per hundred parts by weight of dry pulp, wherein said cationic polymer is added to said slurry in the amount of from about 0.002 to about 1.0 parts by weight per hundred parts by weight of said filler, and wherein said said slurry contains said filler at the point of addition of said cationic polymer.

11. A papermaking process for the manufacture of paper or paperboard by the general steps of forming an aqueous cellulosic slurry, draining said slurry on a screen to form a sheet and drying said sheet, characterized in that a cationic polymer is added to said slurry after the last high Shear stage as substantially a single component retention aid, said cationic polymer having a quaternary ammonium salt cationic charge density of at least about 3.2 equivalents of cationic nitrogen per kilogram of dry polymer, said cationic polymer having an Intrinsic Viscosity of at least about 8 dl/g, wherein said quaternary ammonium salt charge density of said cationic polymer is substantially comprised of the cationic mer units of dialkyl aminoalkyl (meth)acrylates quaternary ammonium salts or mixtures thereof, and wherein said cationic polymer is added to said slurry in the amount of from about 0.001 to about 0.5 parts by weight per hundred parts by weight of dry solids in said slurry.

12. The process of claim 11 the aminoalkyl groups of said dialkyl aminoalkyl(meth)acrylates contain from one to eight carbons, and the alkyl groups of the dialkyl radicals of said dialkyl aminoalkyl(meth)acrylates contain separately from one to four carbons.

13. The process of claim 12 wherein said cationic polymer is a copolymer with (meth)acrylamide.

14. The process of claim 12 wherein said cationic polymer has a cationic charge density of at least 3.3 equivalents of cationic nitrogen per kilogram of dry polymer.

15. The process of claim 12 wherein said cationic polymer is added to said slurry in the amount of from about 0.01 to about 0.03 parts by weight per hundred parts by weight of dry solids in said slurry.

16. A process in which paper or paperboard is made by forming an aqueous cellulosic slurry, draining said slurry on a screen to form a sheet and drying said sheet, characterized in that a cationic polymer having a quaternary ammonium salt cationic charge density of at least about 3.2 equivalents of cationic nitrogen per kilogram of dry polymer and having an Intrinsic Viscosity of at least about 8 dl/g is added to said slurry after the last high shear stage and prior to said draining of said slurry in an amount effective to provide at least about a 50 percent increase in retention wherein said increase in retention is obtained without more than about a 10 percent decrease in formation index as measured by digital image analysis on an index of from about 20 to about 120, wherein said slurry has a consistency of from about 0.1 to about 4.0 at the point of said addition of said cationic polymer, and wherein said cationic polymer is added to said slurry as substantially a single component retention aid.

17. The process of claim 16 wherein said cationic polymer is added to said slurry in an amount effective to provide at least about a 50 percent increase in retention wherein said increase in retention is obtained without more than about a 5 percent decrease in formation index as measured by digital image analysis on an index of from about 20 to about 120.

18. The process of claim 16 wherein said quaternary ammonium salt cationic charge density of said cationic polymer is substantially comprised of the cationic mer units of dialkyl aminoalkyl(meth)acrylates quaternary ammonium salts or mixtures thereof, wherein the aminoalkyl groups of said dialkyl aminoalkyl(meth)acrylates quaternary ammonium salts contain from one to eight carbons, and wherein the alkyl groups of the dialkyl radicals of said dialkyl aminoalkyl(meth)acrylates quaternary ammonium salts separately contain from one to four carbons.

19. The process of claim 18 wherein said cationic polymer is a copolymer comprised substantially of said dialkyl aminoalkyl(meth)acrylates quaternary ammonium salts and (meth)acrylamide.

20. The process of claim 19 wherein said cationic polymer is added to said slurry in the amount of from about 0.01 to about 0.03 parts by weight per hundred parts by weight of dry solids in said slurry.

* * * * *